United States Patent [19]

Garman et al.

[11] Patent Number: 4,786,032

[45] Date of Patent: Nov. 22, 1988

[54] LIFTING APPARATUS

[75] Inventors: David E. T. Garman; Richard M. Rimington, both of Powys, Wales

[73] Assignee: Mangar Aids Limited, Presteigne, Wales

[21] Appl. No.: 52,397

[22] Filed: May 21, 1987

Related U.S. Application Data

[63] Continuation-in-part of Ser. No. 794,502, Nov. 1, 1985, Pat. No. 4,688,760.

[30] Foreign Application Priority Data

Nov. 6, 1984 [GB] United Kingdom ..... 8428009
Feb. 6, 1985 [GB] United Kingdom ..... 8502950
Oct. 9, 1985 [GB] United Kingdom ..... 8524851

[51] Int. Cl.[4] ..... B66F 3/24
[52] U.S. Cl. ..... 254/93 HP; 254/122
[58] Field of Search ..... 254/122, 9 C, 93 HP; 4/564, 565, 566; 187/18, 8.72; 182/63, 69, 14, 16, 141, 157; 92/34–42

[56] References Cited

U.S. PATENT DOCUMENTS 2,070,960 2/1937 Phillips ..... 254/93 HP
2,725,578 12/1955 Keller ..... 254/93 HP
3,401,607 9/1968 Wortman ..... 92/39
3,412,873 11/1968 Barker ..... 187/18
3,695,582 10/1972 Clay ..... 254/93 HP
4,061,310 12/1977 Vetter ..... 254/93 HP
4,560,145 12/1985 Widmer ..... 254/93 HP

FOREIGN PATENT DOCUMENTS 74053 8/1982 European Pat. Off. .
0074460A 6/1983 European Pat. Off. .
0121348A 3/1984 European Pat. Off. .
513561 11/1930 Fed. Rep. of Germany ..... 92/42
2405209 6/1979 France ..... 254/93 HP

*Primary Examiner*—Robert C. Watson
*Attorney, Agent, or Firm*—Neil F. Markva

[57] ABSTRACT

Lifting apparatus comprises a base, a platform disposed above the base, a thrust mechanism therebetween to lift the platform with respect to the base, and a platform stabilizer assembly enclosed within the thrust device to connect the platform and base in a fixed relationship with respect to each other. The platform stabilizer assembly comprises an upper extensible, scissors linkage mechanism having upper end portions connected to the platform and a lower extensible, scissors linkage mechanism having lower end portions connected to the base. The lower end portions of the upper extensible, scissors linkage mechanism are pivotally connected to upper end portions of the lower extensible, scissors linkage mechanism so that the scissors linkage mechanisms are constrained to move in unison. Guides located on the base and platform outside and adjacent the platform stabilizer assembly constrains movement of the stabilizer linkages within the thrust mechanism.

23 Claims, 5 Drawing Sheets

LIFTING APPARATUS

This is a continuation-in-part of our copending U.S. application Serial No. 794,502 filed Nov. 1, 1985, now U.S. Pat. No. 4,688,760.

FIELD OF THE INVENTION

The present invention relates to a lifting apparatus of a type which comprises a base, a platform disposed above the base, thrust means therebetween to lift the platform relative to the base, and platform stabilizing means enclosed within the thrust means to connect the platform and base in parallel.

BACKGROUND OF THE INVENTION

The platform stabilizing means comprises an upper extensible, scissors linkage mechanism having upper end portions connected to the platform and a lower extensible, scissors linkage mechanism having lower end portions connected to the base. The lower end portions of the upper extensible, scissors linkage mechanism are connected to upper end portions of the lower extensible, scissors linkage mechanism so that the linkage mechanisms are constrained to move in unison.

Apparatus of the aforementioned type is shown in U.S. Pat. No. 2,725,578. In this known apparatus, several linkage mechanisms form a part of vertically and horizontally extending bracing means. Three separate lazy-tongs are arranged at the sides of an equilateral triangle forming vertical bracing in three mutually inclined vertical planes. Each lazy-tongs is slidably connected to the base and to the platform, and includes upper and lower linkage mechanisms. An intermediate linkage mechanism serves as a connecting means to connect the upper and lower linkage mechanisms.

A central pivot of each of the known three upper, intermediate and lower linkage mechanisms is connected to a peripheral circular ring member at each respective location. The three horizontally disposed ring members form another part of the bracing means for the known lifting apparatus and are secured to the inside of a pleated bellows which serves as a pneumatic thrust mechanism.

In this known apparatus, the three surrounding ring members and the three separate lazy-tongs necessary for platform stabilizatin give rise to various problems, e.g. an extremely high manufacturing cost, complexity, and, most importantly, poor stabilization of the platform due to uneven or unequal movement (extension or contraction) of the lazy-tongs which allows the platform (and/or ring members) to tilt relative to the horizontal. Furthermore, the bearing or pivot clearances are necessary for relative pivotal movement of the parts of the lazy-tongs with respect to each other and to the ring members. Such clearances allow the platform to move linearly in any direction and top the plane of the platform.

In any lifting position of the prior art platform intermediate its maximum upper and minimum lower positions, the bracing means allows the platform to rotate freely through a restricted but unacceptably large angle, thus failing to stabilize the platform and allowing twisting torsion loads to be applied to the relatively weak bellows. Thus, the platform can pitch, roll and yaw to an unacceptable extent.

The known apparatus requires the ring members to be directly attached to the bellows and, thus, subjects the lazy-tongs to lifting forces produced by the bellows. Such structure gives rise to further problems of wear, friction and malfunction of the platform stabilizing means.

SUMMARY OF THE INVENTION

The lifting apparatus of the invention comprises thrust means located between a first side of a base means and a first side of a platform means to move the platform means with respect to the base means. Platform stabilizing means maintain the base means and the platform means in a fixed, parallel relationship with respect to each other. The platform stabilizing means is separate from the thrust means and wholly devoid of lifting forces. The stabilizing means is enclosed within the thrust means and includes a stabilizing linkage assembly.

The linkage assembly includes a first common pivotal axis at one end thereof fixed with respect to the platform means and a second common pivotal axis at the other end thereof fixed with respect to the base means. A first pair of mutually opposed guide means are disposed on the platform means and a second pair of mutually opposed guide means are disposed on the base means with each said guide means being located outside the linkage assembly to prevent horizontal and vertical movement with respect to the guide means. The linkage assembly includes a third common pivotal axis at said one end thereof slidably mounted in the first pair of guide means on the platform means. A fourth common pivotal axis is located at the other end thereof slidably mounted in the second pair of guide means on the base means.

A particular feature of the invention is directed to first and second pairs of mutually opposed guide means wherein each includes a pair of mutually opposed, elongate channel guide elements located outside of and adjacent to the linkage assembly. The channel guide elements are effective to prevent movement of the linkage assembly in a direction transverse to the longitudinal direction of the channel guide elements. The channel guide elements are releasably secured to and detachable from the base means and platform means in a specific embodiment.

A further feature of the invention is directed to the linkage assembly which includes first main pivot means projecting outwardly from the first common pivotal axis, second main pivot means projecting outwardly from the second common pivotal axis, third main pivot means projecting outwardly along the third common pivotal axis and fourth main pivot means projecting outwardly along the fourth common pivotal axis. The third and fourth pivot means are supported by slider members slidably receivable within each pair of guide means.

Another feature of the invention is directed to first and second pivot means which comprise first and second rigid rods extending along the first and second common pivotal axes and extending across the platform stabilizing means and being secured at the outer end thereof outside the linkage assembly. Where the first and second pair of guide means each include a pair of mutually opposed, elongate channel guide elements, the first and second pivot means are secured in an end portion of each said pair of channel guide elements located on the platform means and on the base means.

Another embodiment of the inventive lifting apparatus comprises platform stabilizing means separate from and enclosed within the thrust means while being wholly devoid of lifting forces. The platform stabilizing means includes a stabilizing linkage assembly including a single, unitary, rigid, inner link member and two outer, rigid link members each disposed on opposite sides of the inner link member. The inner and outer link members are pivotally mounted around an intermediate, common pivotal axis extending through the inner and outer link members forming a scissors linkage mechanism. The linkage mechanism includes means for connecting the two outer link members to operate as a unit with respect to the single, unitary, rigid, inner link member.

In a particular embodiment there are two scissors linkage mechanisms each having a single, unitary, rigid, inner link member and two outer, rigid link members pivotally mounted around an intermediate, common pivotal axis extending through the inner and outer link members. Mutually opposed guide means are disposed on the platform means and base means outside the scissors linkage mechanisms.

The scissors linkage mechanism of this embodiment includes a first common pivotal axis at one end thereof fixed with respect to the platform means, a second common pivotal axis at the other end thereof fixed with respect to the base means, a third common pivotal axis at said one end thereof slidably mounted in the guide means on the platform means, and a fourth common pivotal axis at the other end thereof slidably mounted in the pair of guide means on the base means. The two scissors linkage mechanisms are pivotally connected to each other at a fifth and sixth common pivotal axis located at the ends of each rigid link member in each said scissors linkage mechanism opposite the pivotal axes ends connected to the guide means.

A particular feature of this invention is directed to the single, unitary, rigid, inner link member of the scissors linkage mechanism which link member extends across the width of the linkage assembly and includes an enclosed bearing socket. The length to diameter ratio of the bearing socket is at least 2:1 in a specific embodiment.

A further embodiment of the inventive lifting apparatus comprises pneumatic thrust means located between a first side of a base means and a first side of a platform means to move the platform means with respect to the base means. Platform stabilizing means maintain the base means and the platform means at a fixed, parallel relationship with respect to one another. The platform stabilizing means is separate from and enclosed within the pneumatic thrust means while being wholly devoid of lifting forces. The pneumatic thrust means includes inlet means applying lifting forces to the platform means independently of the platform stabilizing means. The thrust means includes first means to sealingly connect one end of the thrust means to the first side of the base means and second means to sealing connect the other end of the thrust means to the first side of the platform means to contain the gaseous material within the pneumatic thrust means.

Lifting limiting means automatically limit the distance the platform means moves with respect to the base means when a preselected height is reached by the platform means. In a specific embodiment, the limiting means includes abutment means located in the first and second pairs of guide means to stop movement of the slidably mounted pivotal axes within the guide means.

A particular feature of the pneumatic thrust means is that it comprises a bellows including a flexible wall having vertically spaced horizontal stiffeners and being substantially rectangular in plan. The stiffeners are mounted to the flexible wall independently of the platform stabilizing means. The stiffeners may have a flattened cross-section or a tapered cross-section and may be cast or injection molded. The stiffeners are bonded to inwardly projecting flexible portions of the wall within the extensible member.

A lifting apparatus according to the present invention comprises upper and lower extensible, scissors mechanisms. The upper extensible, scissors mechanism has an inner link member with two upper end portions secured to the platform. These upper end portions are constrained to fixed pivotal movement about an upper common axis fixed with respect to the platform. The upper extensible, scissors linkage mechanism has two link members with upper end portions movable linearly of the platform and in a direction perpendicular to the upper common fixed axis. The lower extensible, scissors linkage mechanism has two outer link members with end portions secured to the base by lower pivot means to be constrained for fixed pivotal movement about a lower common axis fixed with respect to the base. The lower common axis is disposed vertically below, and parallel with, the upper common axis. An inner link member includes two lower end portions of the lower extensible linkage device. The lower end portions are movable linearly with respect to the base and in a direction perpendicular to the lower common fixed axis.

In particular, the present invention provides an apparatus of the aforementioned type wherein linkage mechanisms comprise rigid members, which are pivotally connected, to arcuately move about axes which are maintained mutually in parallel by the rigid members. An upper one of these axes is fixed in relation to the platform and a lower one of these axes is fixed in relation to the base so that the platform is constrained against arcuate movement, relative to the base, in all positions of the platform.

The present invention also provides apparatus of the aforementioned type wherein each linkage mechanism comprises a single rigid, inner link member pivotally secured between two outer rigid members by a median pivot to hold the outer rigid members in spaced apart relationship for constrained arcuate movement about a common median axis. In addition, connecting means comprise a plurality of intermediate axes, each of which passes through end portions of the inner, rigid member of one of the linkage mechanisms and the outer rigid members of the other of the linkage mechanisms to confine these outer, rigid members to arcuate movement relative to the inner, rigid member.

The present invention further provides a lifting apparatus of the aforementioned type wherein:

(a) the upper and lower extensible, scissors linkage mechanisms each comprise an inner, rigid member, which provides two of said upper end portions and two of said lower end portions in rigid spaced apart relationship. The inner, rigid member is pivotally secured between two outer, rigid members by median pivot means. Thus, the outer, rigid members are held in spaced apart relationship for constrained arcuate movement about a common median axis; and (b) a first two of the upper end portions of the upper extensible, scissors linkage mechanism are secured to a platform by upper pivot means to be constrained to pivotal movement about an upper common axis fixed in relation to the platform so that a second two of the upper end portions of the upper extensible, scissors linkage mechanisms are movable linearly of the platform and in a direction perpendicular to the upper common fixed axis. A first two of the lower end portions of the lower extensible, scissors linkage mechanisms are secured to the base by lower pivot means to be constrained for pivotal movement about a lower common axis which is fixed relative to the base and is disposed vertically below and parallel with the upper common axis. Thus, a second two of the lower end portions of the lower extensible, scissors linkage mechanisms are movable in unison linearly relative to the base and in a direction perpendicular to the lower common axis.

The inventive apparatus is particularly suitable for low pressure pneumatic operation, e.g. those operations using a pneumatic supply of less than 1 kilogram per square centimeter, and preferably less than 0.5 kilograms per square centimeter (0.5 kg/cm$^2$).

Since the platform stabilizing means is of a particularly rigid construction in relation to movement about the axes, and is substantially relieved of all lifting loads, the extended angle between the inner and outer rigid members may be very large at a maximum lift. The inventive lifting apparatus is arranged so that this angle can be at least 130°, and preferably at least 135°, so that the maximum distance between the platform and base can be about 80% of the combined overall length (height) of the inner rigid members, without loss of platform stability.

Biasing means and/or motion damping means may be enclosed in the thrust means to act on the platform stabilizing means. Lift limiting means may also be provided to limit the maximum distance between the base and the platform.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED INVENTION

Figure 1:
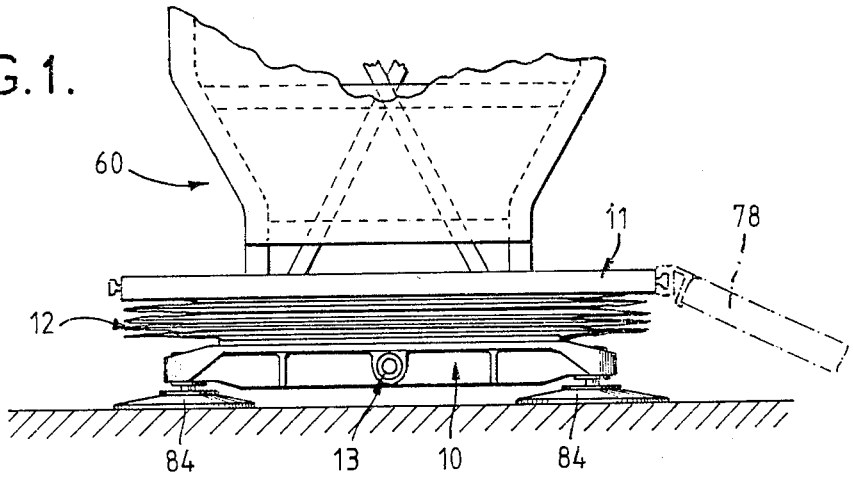
FIG. 1 is a front, fragmentary elevational view of a lifting apparatus according to the present invention, with the lifting apparatus being in a lowered position.

The lifting apparatus of the invention comprises a low pressure pneumatic thrust mechanism, generally designated 12, displaceably connects a platform 11 to a base 10. Inlet means 13 admits pressurized fluid into bellows thrust mechanism 12. A platform stabilizing mechanism, generally designated 14, is located between base 10 and platform 11 and surrounded by thrust mechanism 12.

Thrust mechanism 12 includes a flexible wall 15 having a large area, concertina bellows sealed at one end to base 10 and at the other end thereof to platform 11. Inlet means 13 comprises a valve and fluid plug socket in base 10 in this specific embodiment. However, such inlet means may be located in platform 11 or in wall 15.

Platform stabilizing mechanism 14 includes an upper extensible, scissors linkage assembly, generally designated 20, a lower extensible, scissors linkage assembly, generally designated 21, and connector means 18 pivotally connecting assemblies 20 and 21. The connector means may include an extensible linkage device.

Each assembly 20 and 21 comprises a single, three rigid member scissors linkage including two elongate outer rigid members 16 connected by median pivot means to opposite sides of an inner rigid member 19 so as to be relatively, angularly movable. Rods 28 constitute the median pivot means. As is evident in the drawings, rigid, inner link members 19 of linkage assemblies 20 and 21 are of a single, unitary structure and extend across the width of each assembly 20 and 21. When linkage assemblies 20 and 21 increase in height and decrease in width, an angle A between inner member 19 and outer members 16 is increased, and vice versa.

Figure 3:
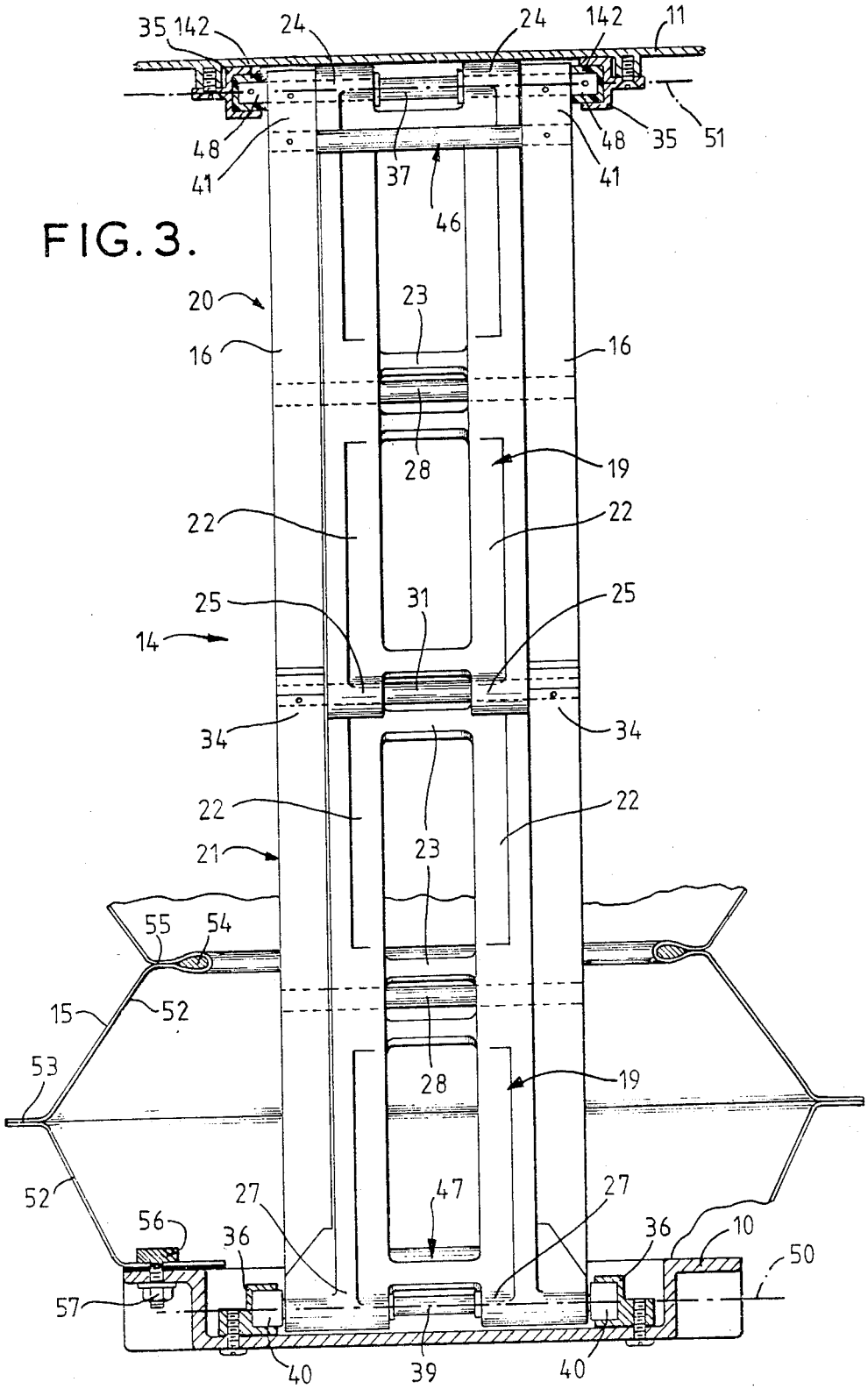
FIG. 3 is a front, fragmentary elevational view, partially in section, of a platform stabilizing means of the lifting apparatus according to the invention.
Figure 4:
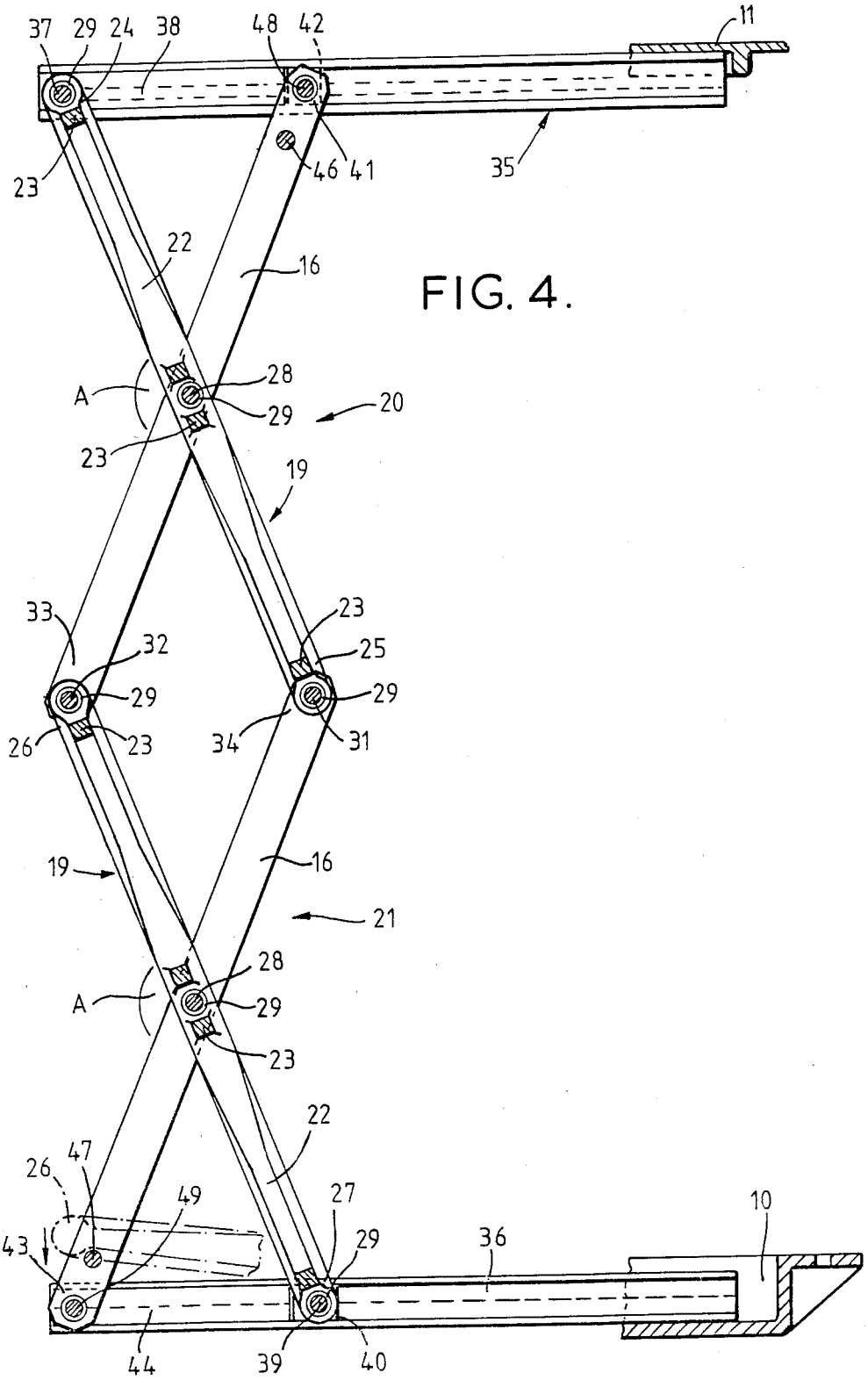
FIG. 4 is a vertical cross-sectional view of the platform stabilizing means of FIG. 3.
Figure 5:
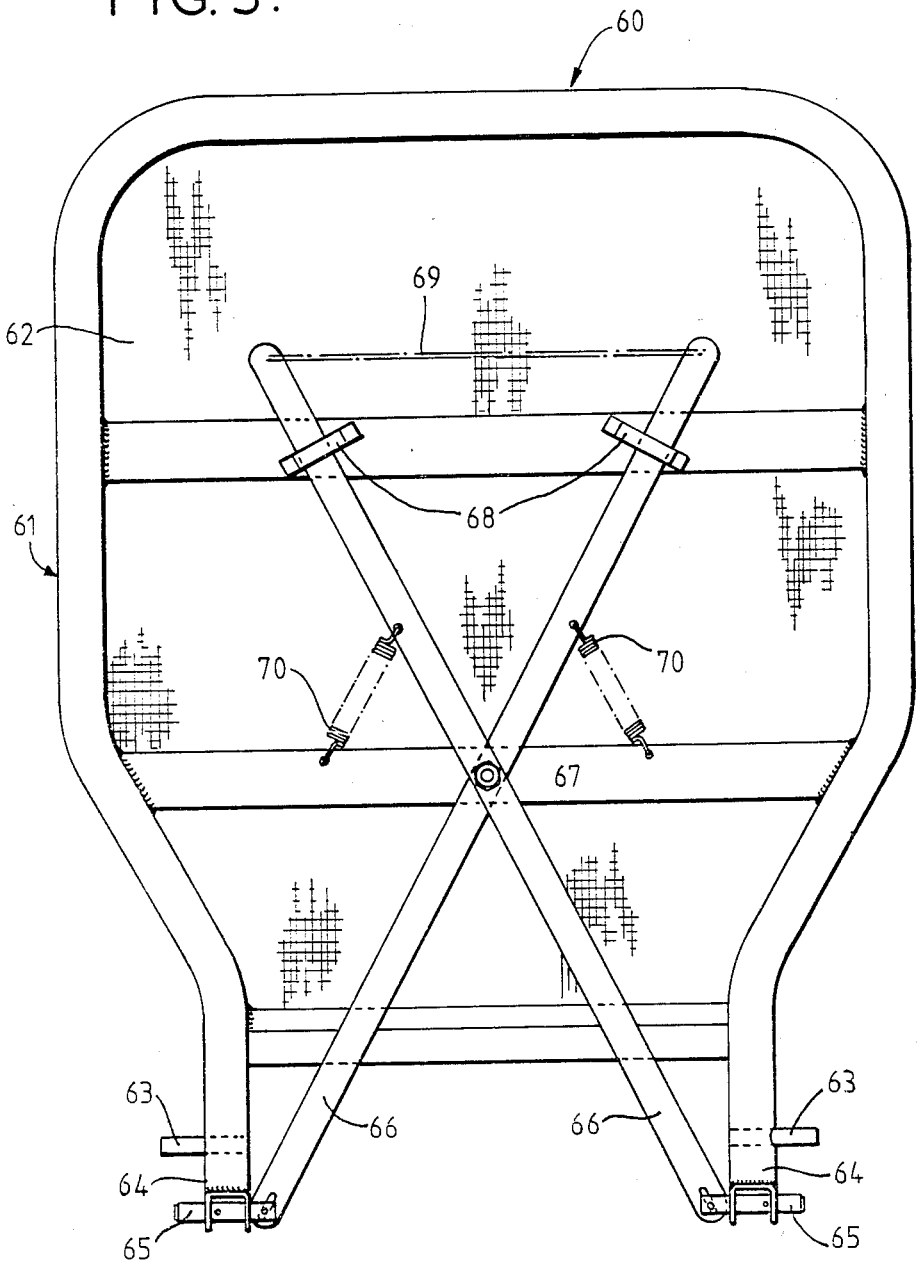
FIG. 5 is a rear elevational view of a backrest assembly for the lifting apparatus according to the invention.

Rigid linkage members 16 and 19 are composed of a strong metal or alloy, e.g. aluminum alloy, and are cast or machined. In transverse cross-section, members 16 and the main portions 22 of members 19 are substantially as wide as they are thick. Rigid, integral transverse portions 23 secure main portions 22 of each member 19 in rigid parallel relationship with respect to each other. Transverse portions 23 are disposed adjacent and on each side of median pivot rods 28 and also extend between projecting end portions 24, 25, 26 and 27 of main portions 22, as shown in FIGS. 3 and 4. One or more of the extreme transverse portions 23 may be hollow and extend to the ends of rigid member 19 to close the gap between the end portions 24,24; 25,25; 26,26; and/or 27,27, and to further integrally unite said end portions.

At each median pivot for assemblies 20 and 21, rigid metal rod 28 extends through axially elongate bearing sockets 29 (FIG. 4) and transversely horizontally across each entire linkage assembly 20 and 21 (FIG. 3).

Parallel intermediate pivot means comprises metal rods 31 and 32 which extend across linkage assemblies 20 and 21 through bearing sockets 29. Rod 32 connects upper end portions 26 of lower member 19 to lower end portions 33 of upper members 16. Similarly, rod 31 connects the lower end portions 25 of upper member 19 to upper end portions 34 of lower members 16.

Thus, the scissors linkage mechanism comprises assemblies 20 and 21 including a first common pivotal axis at one end thereof fixed with respect to platform 11 via rod 37, a second common pivotal axis at the other end thereof fixed with respect to base 10 via short rods 49, a third common pivotal axis at said one end thereof slidably mounted in guide elements 35 on platform 11 via short rods 48, and a fourth common pivotal axis at the other end thereof slidably mounted in the pair of guide elements 36 on base 10 via rod 39. The two linkage assemblies 20 and 21 are pivotally connected to each other via rods 32 and 31 at a fifth and sixth common pivotal axis located at end portions 25, 33 and 26, 34 of each rigid link member in each scissors linkage assembly 20 and 21 opposite the pivotal axes end portions 24, 41 and 27, 43 connected to respective guide elements 35 and 36.

Respective pairs of mutually opposed, upper, elongate guide elements 35 and lower, elongate guide elements 36 are releasably secured to platform 11 and base 10. Guide elements 35 and 36 are of channel form, arranged in parallel, and offset outwardly from linkage assemblies 20 and 21. That is, guide elements 35 and 36 are located outside and adjacent to assemblies 20 and 21 to prevent horizontal and vertical movement with respect to elements 35 and 36 as shown.

Upper end portions 24 of upper member 19 support a metal rod 37 in bearing sockets 29. Rod 37 has outwardly projecting end portions (not shown) fixedly secured to each end part of upper guide elements 35 and bedded in a plastics block 38 fixed in guide elements 35. Lower end portions 27 of lower members 19 similarly support a further metal rod 39 having outwardly projecting end portions (not shown) bedded in plastics-block sliders 40 that maintain a tight sliding fit within lower guide elements 36. The end portions 24 and 27 of inner link members 19 extend outwardly adjacent to guides 35 and 36 to further support rods 37 and 39 (See particularly the structure of end portions 27 as shown in FIG. 3).

Rods 28, 31, 32, 37 and 39 provide bracing for the respective end portions and are a close, or push fit in bearing sockets 29. In this embodiment, the axial length to diameter ratio of bearing sockets 29 is at least 1:1.

Upper end portions 41 of upper members 16 may support a single rod, which is similar to rod 39 having end portions embedded in plastics, block sliders 42 in upper guide element 35. Lower end portions 43 of lower members 16 may support a single rod, which is similar to rod 37 having end portions embedded in plastics blocks 44 which are fixed in the lower guide elements 36. However, in the embodiment shown, a rigid, upper bar 46 extends horizontally between, and is secured to upper end portions 41 and a similar rigid, lower bar 47 is secured to lower end portions 43 of lower members 16. Rods 46 and 47 provide rigid spacing and bracing for respective end portions 41 and 43, so that a weight saving can be made by mounting respective individual short rods 48 and 49 in end portions 41 and 43 to respectively engage the sliders 42 and blocks 44.

As an alternative to the use of plastics block sliders 40 and 42, the outwardly projecting end of rods 48 may be slidable in low-friction plastics channel section inserts 142 within the guide elements 35 as shown in FIG. 3.

While in use, rods 37 and 49, respectively, serve as upper pivot means and lower pivot means, and provide an upper horizontal common fixed axis and a lower horizontal common fixed axis which is vertically below, and parallel with, the upper common fixed axis. Thus, respective end portions 24 and 43 are restricted solely to pivoted movement relative to platform 11 and base 10.

Rods 39 and 48, respectively, serve as lower main pivot means and upper main pivot means, and provide lower and upper horizontal common main axes 50 and 51 (FIG. 3) for pivotal movement of the end portions 27 and 41 relative to the sliders 40 and 42. Axes 50 and 51 are solely horizontally movable in unison remains vertically above, and parallel with, lower main axis 50.

In the fully raised maximum lift position (FIGS. 3 and 4), sliders 40 and 42 abut respective blocks 44 and 38 which thus serve as stop means to prevent further lift which would increase the angle A beyond a maximum of 140°. Sliders 40 and 42 move forwards (away from blocks 44 and 38) as platorm 11 is lowered. Consequently, linkage assemblies 20 and 21 retract downwardly and extend forwardly thereby decreasing angle A, until further movement is halted by end portions 34 and 33 abutting respective end portions 27 and 24. End portions 27 and 41 are outwardly extended to serve as stop means in the lowered position, so that the pairs of guide elements 35 and 36 and pivots 39 and 48 are not subjected to any major stresses.

During movement of platform 11, the relatively large axial length to diameter ratio (i.e. at least 2:1) of bearing sockets 29, in combination with the close or tight fit of all rods in bearing sockets 29, blocks 44 and 38 and sliders 40 and 42, prevent any significant unwanted movements of said axes from their precisely parallel relationships. This configuration also serves to minimize wear. Furthermore, only the linearly sliding surfaces of the sliders 40 and 42 are subjected to any slow but significant wear during repeated operation. Sliders 40 and 42 can be replaced cheaply and easily after simply removing guide elements 35 and 36 which serve as releasable connecting means that connect the stabilizing means 14 to base 10 and platform 11. As disclosed, stabilizing mechanism 14 is wholly devoid of lifting forces and is enclosed in the thrust means so as to be safe to operate in a hospital or domestic environment.

Figure 2:
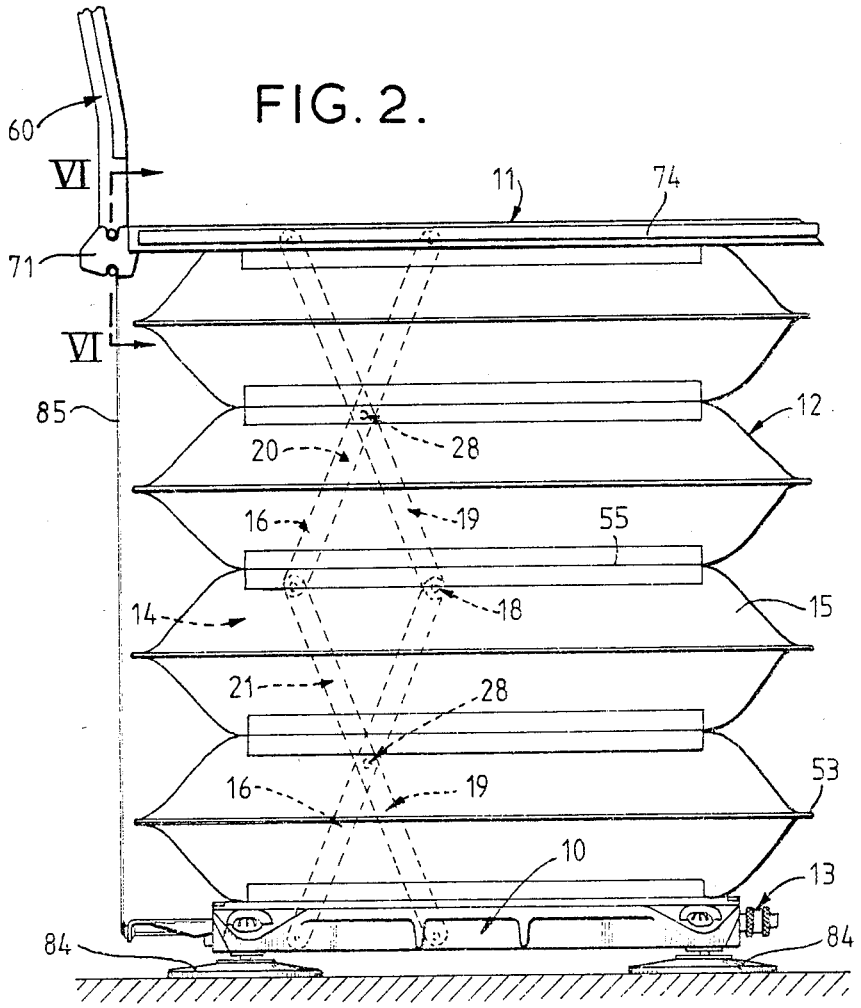
FIG. 2 is a side, fragmentary elevational view of the lifting apparatus of FIG. 1 shown in a fully raised position.

FIGS. 2 and 3 show flexible wall 15 as a segmental construction including strips 52 of impervious, and flexible but substantially inelastic, material which is bonded together at outer junctions 53, and is bonded together and to stiffeners 54 at inner junctions 55. Stiffeners 54 are of flattened cross-section so that the height is small in relation to the width thereof, have rounded or tapered edges, are substantially rectangular in plan, are enclosed in said material and are disposed within said wall, as shown in FIG. 3. Stiffeners 54, as shown, necessarily resist bending loads in the straight sided bellows wall 15.

Thus, as shown in the drawings, bellows thrust mechanism 12 defines an internal rectangular compartment housing stabilizing mechanism 14 having its rigid frame structure fitted internally to reduce chafing of the inside of wall 15 and to protect the frame from corrosion.

The lowermost and uppermost strips 52 are respectively clamped to base 10 and platform 11 by a clamping ring 56 and fasteners 57. The clamped structures effect a seal at base 10 and platform 11 to render thrust mechanism 12 airtight except for inlet valve 13. This allows platform 11 to be raised or lowered by inflation or deflation of thrust mechanism 12. Since the large area bellows wall 15 allows a large load to be lifted by a direct thrust on platform 11, stabilizing mechanism 14 is not subjected to any lifting loads. For example, a load of about 100 kg can be lifted on a platform 11 of about 0.15 $m^2$ in area through a distance of 40 cm by a pneumatic supply pressure of only about 0.35 $kg/cm^2$.

With the configuration of stabilizing mechanism 14 acting separately and independently of bellows thrust mechanism 12 and the particular linkage structure of stabilizing mechanism 14, platform 11 used as a seat for a person is able to go near ground level while remaining parallel to base 10. When the lifting apparatus is designed for use in the confines of a bathtub, providing room for the legs of the person using it, it is contemplated that a single scissors linkage assembly be used to achieve an ultimately slack free operation.

The lifting apparatus of FIGS. 1, 2, 5 and 6 may be arranged to support and lift a person. In this embodiment, the inventive apparatus comprises a backrest assembly 60 including a frame 61, a molded plastics facing 62 and oppositely directed lugs 63 located on lower portions 64 of frame 61. Bolts 65 slidably mounted on lower portions 64 support one end of crossed levers 66 pivotally mounted to a central pivot 67. Guides 68 on frame 61 slidably support crossed levers 66 and a cross-rope 69 connects the upper ends of levers 66. When pulled upwardly, rope 69 causes bolts 65 to be retracted inwardly against a bias of springs 70.

The rear of platform 11 includes a pair of mountings 71, each having an upwardly open socket 72 to receive a lug 63, and a parallel downwardly open socket 73 to accept a bolt 65 thereby removably securing backrest assembly 60 to platform 11. When bolts 65 are retracted, as indicated in broken lines in FIG. 6, backrest assembly 60 can be simply lifted off platform 11.

Figure 6:
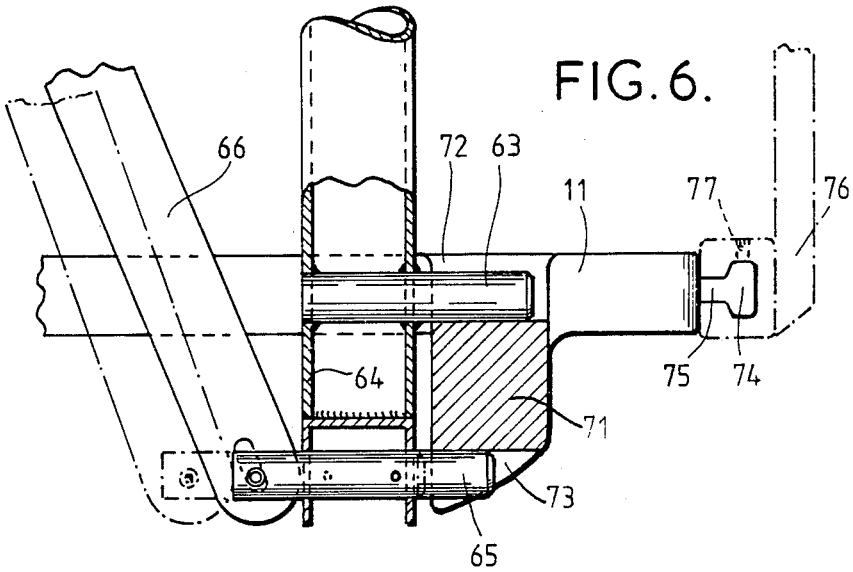
FIG. 6 is a fragmentary, detailed sectional view along line VI—VI of FIG. 2.
Figure 7:
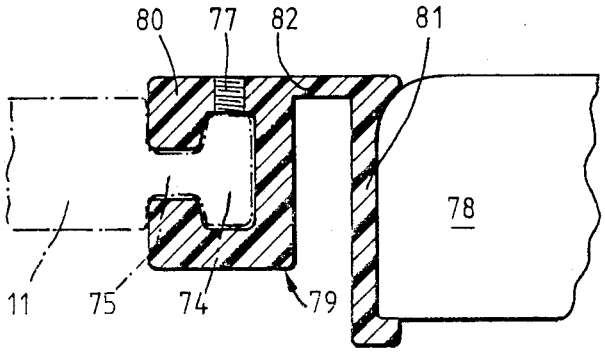
FIG. 7 is a cross-sectional view of a hinge for connecting a platform and flank panel of the apparatus according to the invention.

An elongate and headed protuberance 74 is joined along each side to platform 11 by a neck 75. Protuberances 74 serve as mountings for slide-on supports 76 such as for armrests or similar fittings. Clamping screws 77 secure supports 76 in fixed positions on platform 11 as shown in FIG. 6, or as mountings for flank panels 78 as shown in FIG. 7 and indicated in broken lines in FIG. 1.

Flank panels 78 operate, and are used, as described in British patent specification No. 2,110,527. A plastic hinge 79 secures flank panels 78 to mountings 74, 75. Hinge 79 comprises a first elongate portion 80 shaped to fit onto mounting 74, 75 and a second portion 81 secured to panel 78. A thin, flexible portion 82 connects hinge portions 80 and 81. Hinge 79 is a unitary/coextrusion of relatively rigid plastics material forming portions 80 and 81 with a relatively flexible plastics material forming portion 82.

Base 10 includes four swivel mounted, suction feet 84. A lift limiting cord 85 actuates the closing of inlet plug socket valve 13 and thereby limits inflation of thrust mechanism 12. Cord 85 may be adjustably secured to platform 11, backrest 60, or an armrest.

The present invention is not confined to details of the foregoing examples, and many variations are possible within the scope of the invention. For example, the longitudinal orientation of assemblies 20 and 21, as shown in FIG. 4, may be reversed so that the upper pivots locate the upper end portions 41. The connecting means may also comprise an intermediate extensible linkage assembly having the structure of assemblies 20 and 21 with two additional rods similar to the rods 32 and 31 pivotally connecting the, then, three linkage assemblies together.

Clearly, any of the rods extending across the linkage assemblies may be replaced by pairs of co-axially aligned short rods, e.g. similar to the rods 48 and 49, which act to connect together the rigid members or to connect the rigid members to the blocks or sliders, and permit arcuate movement about the rod axes thereby providing respective pivot means.

The rigid members, guides, mountings, and pivots may be of any suitable construction and configuration. The rigid members may also be cast so as to have rounded edges.

The stabilizing mechanism may incorporate stops, dampers, shock absorbers, or biasing means to limit, smooth, or bias the movement of the rollers or sliders relative to the guides elements 35 and 36.

The flexible bellows wall 15 may be of any suitable form and of any suitable construction; and may be secured to the platform and base in any suitable manner. The corners of the wall may also be rounded to facilitate sealing.

Connectors may be included to enable several units of the apparatus to be arranged in a stack or row and to be connected to operate sequentially or in unison. The connectors may also incorporate self-sealing fluid couplings.

The inventive apparatus is particularly suitable for operation in connection with a low pressure compressed air supply; and may include a manually operable valve to control admission and release of air into and out from the thrust mechanism, along with a pressure relief valve which acts to limit the maximum working air pressure within the thrust mechanism.

The inventive apparatus may also include manually releasable safety means which hold the platform at a selected or predetermined height.

The inventive apparatus is capable of being used in a wide variety of applications, may carry a variety of fittings, and may be mounted on a variety of supports. The base and platform may be shaped to suit the supports and fittings, and may include a removable or openable inspection or maintenance hatch or panel which provides access to the linkages and other components within the thrust mechanism. The apparatus may also be operated in any required orientation, e.g. may be inclined to the vertical or may be horizontal (the terms "vertical", "horizontal", and "front" being used herein in relation to the apparatus when it is orientated as shown in the drawings).

While the lifting apparatus has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A lifting apparatus comprising:

(a) thrust means located between a first side of a base means and a first side of a platform means to move the platform means with respect to the base means, (b) platform stabilizing means for maintaining the base means and the platform means in fixed relationship with respect to one another, (c) the platform stabilizing means being enclosed within the thrust means and including a stabilizing linkage assembly being separate from the thrust means and wholly devoid of lifting forces, (d) said linkage assembly including first pivot means extending along a first common pivotal axis at one end thereof, said first common pivotal axis being fixed with respect to the platform means and second pivot means extending along a second common pivotal axis at the other end thereof, said second common pivotal axis being fixed with respect to the base means, (e) a first pair of mutually opposed guide means disposed on the platform means and a second pair of mutually opposed guide means disposed on the base means with each said guide means being located outside said linkage assembly to prevent horizontal and vertical movement of the linkage assembly with respect to the guide means, (f) said linkage assembly including third pivot means extending along a third common pivotal axis at said one end thereof, said third pivot means being slidably mounted in said first pair of guide means on the platform means and fourth pivot means extending along a fourth common pivotal axis at said other end thereof, said fourth pivot means being slidably mounted in said second pair of guide means on the base means.

2. An apparatus as defined in claim 1 wherein said first and second pairs of mutually opposed guide means each includes a pair of mutually opposed, elongate channel guide elements located outside and adjacent the linkage assembly, means mounting said pivot means to said channel guide elements to prevent movement of the linkage assembly in a direction transverse to the longitudinal direction of the channel guide elements.

3. An apparatus as defined in claim 2 wherein the channel guide elements are releasably secured to and detachable from the base means and platform means.

4. An apparatus as defined in claim 1 wherein said first pivot means projects outwardly from the linkage assembly along said first common pivotal axis, said second pivot means projects outwardly from the linkage assembly along said second common pivotal axis, said third pivot means projects outwardly from the linkage assembly along said third common pivotal axis, and said fourth pivot means projects outwardly from the linkage assembly along said fourth common pivotal axis, said third and fourth outwardly projecting pivot means being supported by slider members slidably receivable within each said pair of guide means.

5. An apparatus as defined in claim 4 wherein said pivot means comprise rigid rods extending along said common pivotal axes and extending across the stabilizing linkage assembly and being secured at the outer ends thereof outside said linkage assembly.

6. An apparatus as defined in claim 5 wherein said first and second pair of guide means each includes of a pair of mutually opposed, elongate channel guide elements, and said first and second pivot means are secured to an end portion of each said pair of channel guide elements located on said platform means and on said base means.

7. A lifting apparatus comprising:

(a) thrust means located between a first side of a base means and a first side of a platform means to move the platform means with respect to the base means, (b) platform stabilizing linkage assembly for maintaining the base means and the platform means in fixed relationship with respect to one another, (c) the platform stabilizing linkage assembly being enclosed within the thrust means and including a single, unitary, rigid inner link member and two outer rigid link members each disposed on opposed sides of said inner link member which extends across the width of the linkage assembly, (d) said inner and outer link members being pivotally mounted around an intermediate, common pivotal axis extending through the inner and outer link members to form a scissors linkage mechanism.

8. An apparatus as defined in claim 7 wherein said linkage assembly includes two said scissors linkage mechanisms each having a singe, unitary, rigid inner link member and two outer rigid link members pivotally mounted around an intermediate common pivotal axis extending through the inner and outer link members, each said inner link member extends across the width of each respective scissors linkage mechanism.

9. An apparatus as defined in claim 8 wherein mutually opposed guide means are disposed on the platform means and base means outside the scissors linkage mechanism, said linkage assembly includes first pivot means extending along a first common pivotal axis at one end thereof, said first common pivotal axis being fixed with respect to the platform means, second pivot means extending along a second common pivotal axis at the other end thereof, said second common pivotal axis being fixed with respect to the base means, third pivot means extending along a third comon pivotal axis at said one end thereof, said third pivot means being slidably mounted in said guide means on the platform means, and fourth pivot means extending along a fourth common pivotal axis at said other end thereof, said fourth pivot means being slidably mounted in said pair of guide means on the base means, said two scissors linkage mechanisms being pivotally connected to each other at a fifth and sixth common pivotal axis at the ends of each rigid link member in each said scissors linkage mechanism opposite the pivotal axes ends connected to said guide means.

10. An apparatus as defined in claim 7 wherein said linkage assembly includes pivot means mounted to bearing sockets located in the single, unitary, rigid inner link member of the scissors linkage mechanism.

11. An apparatus as defined in claim 10 wherein the length to diameter ratio of the bearing sockets is at least 2:1.

12. An apparatus as defined in claim 10 wherein a first pair of mutually opposed guide means is disposed on the platform means and a second pair of mutually opposed guide means is disposed on the base means with each said guide means being located outside said linkage assembly to prevent horizontal and vertical movement of the linkage assembly with respect to the guide means, said first and second pair of mutually opposed guide means each includes a pair of mutually opposed, channel guide elements located outside and adjacent the linkage assembly, and means mounting said pivot means to said channel guide elements to prevent movement of the linkage assembly in a direction transverse to the longitudinal direction of the channel guide elements.

13. An apparatus as defined in claim 12 wherein the channel guide members are releasably secured to and detachable from the respective base means and platform means.

14. An apparatus as defined in claim 12 wherein said pivot means includes first pivot means projecting outwardly from said linkage assembly along a first common pivotal axis, second pivot means projecting outwardly from said linkage assembly along a second common pivotal axis, third pivot means projecting outwardly from said linkage assembly along a third common pivotal axis, and fourth pivot means projecting outwardly from said linkage mechanism along a fourth common pivotal axis, said third and fourth pivot means being supported by slider members slidably receivable within each said pair of guide means.

15. An apparatus as defined in claim 14 wherein said first and second pivot means comprise rigid rods extending along said common pivotal axes and extending across the platform stabilizing linkage assembly and being secured at the outer ends thereof outside said linkage assembly.

16. A lifting apparatus comprising:

(a) pneumatic thrust means located between a first side of a base means and a first side of a platform means to move the platform means with respect to the base means, (b) platform stabilizing means for maintaining the base means and the platform means in fixed parallel relationship with respect to one another, (c) the platform stabilizing means being separate from and enclosed within the thrust means while being wholly devoid of lifting forces, (d) said pneumatic thrust means includes inlet means to allow a gaseous material to inflate the thrust means for applying lifting forces to the platform means independently of the platform stabilizing means, (e) said thrust means including first means to sealingly connect one end of the thrust means to the first side of the base means and second means to sealingly connect the other end of the thrust means to the first side of the platform means to contain the gaseous material within the pneumatic thrust means, (f) the stabilizing means including a stabilizing linkage assembly having first pivot means extending along a first common pivotal axis at one end thereof, said first common pivotal axis being fixed with respect to the platform means and second pivot means extending along a second common pivotal axis at the other end thereof, said second common pivotal axis being fixed with respect to the base means, (g) a first pair of mutually opposed guide means disposed on the platform means and a second pair of mutually opposed guide means disposed on the base means with each said guide means being located outside said linkage assembly to prevent horizontal and vertical movement of the linkage assembly with respect to the guide means, (h) said linkage assembly including third pivot means extending along a third common pivotal axis at said one end thereof, said third pivot means being slidably mounted in said first pair of guide means on the platform means and fourth pivot means extending along a fourth common pivotal axis at said other end thereof, said fourth pivot means being slidably mounted in said second pair of guide means on the base means, (i) said first and second pair of guide means including abutment means to stop movement of the slidably mounted third and fourth pivot means within the guide means.

17. An apparatus as defined in claim 16 wherein said pneumatic thrust means comprises a bellows including a flexible wall composed of substantially inelastic material and having vertically spaced horizontal stiffeners, said stiffenrs being bonded to said flexible wall independently of the platform stabilizing means.

18. An apparatus as defined in claim 17 wherein said stiffeners have a flattened cross-section, and are disposed within said wall.

19. An apparatus as defined in claim 17 wherein said stiffeners have a tapered cross-section, and are disposed within said wall.

20. An apparatus as defined in claim 17 wherein said flexible wall has a generally rectangular plan cross-section defining an internal rectangular compartment to receive said platform stabilizing means on the inside thereof.

21. An apparatus as defined in claim 16 wherein the platform stabilizing means includes an upper extensible, scissors linkage mechanism and a lower extensible scissors linkage mechanism, said upper extensible, scissors linkage mechanism includes upper end portions pivotally connected to the platform means, said lower extensible, scissors linkage mechanism includes lower end portions pivotally connected to the base means, said upper extensible, scissors linkage mechanism includes lower end portions and said lower extensible scissors linkage mechanism having upper end portions, and connecting means pivotally connect the lower end portions of the upper extensible, scissors linkage mechanism to the upper end portions of the lower extensible, scissors linkage mechanism to cause the two scissors linkage mechanisms to move in unison.

22. An apparatus as defined in claim 7 wherein said linkage assembly including means for connecting the two outer link members to operate as a unit with respect to the single, unitary, rigid inner link member.

23. An apparatus as defined in claim 17 wherein the stiffeners are enclosed in said material and disposed within said wall.

* * * * *